United States Patent [19]

Arabori et al.

[11] Patent Number: 4,852,694

[45] Date of Patent: Aug. 1, 1989

[54] ELEVATOR STARTING COMPENSATION METHOD AND APPARATUS

[75] Inventors: Noboru Arabori; Hideaki Takahashi, both of Katsuta; Yoshio Sakai, Ibaraki; Kenji Yoneda, Katsuta, all of Japan

[73] Assignee: Hitachi, Ltd., Tokyo, Japan

[21] Appl. No.: 183,088

[22] Filed: Apr. 19, 1988

[51] Int. Cl.[4] ..... B66B 1/44

[52] U.S. Cl. ..... 187/115

[58] Field of Search ..... 187/115

[56] References Cited

U.S. PATENT DOCUMENTS 4,553,640 11/1985 Inaba et al. ..... 187/115

4,738,337 4/1988 Caputo ..... 187/115

FOREIGN PATENT DOCUMENTS 53-4947 1/1978 Japan ..... 187/115

*Primary Examiner*—Shoop, Jr. William M.

*Assistant Examiner*—W. E. Duncanson, Jr.

*Attorney, Agent, or Firm*—Antonelli, Terry & Wands

[57] ABSTRACT

Elevator starting compensation for preventing bounding and dash-out phenomena of an elevator cage possibly occurring due to unbalanced torque produced by a difference in weight between the cage and a counter weight. Adjusting quantities utilized in the starting compensation are arithmetically determined by a microcomputer employed for the elevator control, the result of the arithmetic operation being are stored in an electrically erasable programmable read-only memory. The starting compensation is performed on the basis of the adjusting quantities stored in the memory. The adjustment is facilitated.

5 Claims, 6 Drawing Sheets

ELEVATOR STARTING COMPENSATION METHOD AND APPARATUS

BACKGROUND OF THE INVENTION

The present invention relates generally to a starting compensation method and apparatus for an elevator and more particularly to an elevator starting compensation method and apparatus suited advantageously for facilitating the regulation or adjustment of the starting compensation with the aid of a microcomputer.

With the phrase "elevator starting compensation", it is intended to mean such an operation in which a compensating torque comparable to an unbalanced torque which is possibly produced due to a difference in weight between an elevator cage and a counter weight is generated to thereby prevent occurrence of the undesirable phenomena such as bouncing, dash-out or the like at the time of starting the elevator cage.

In general, the counter weight is so selected as to be balanced with the weight of an associated elevator cage which is under the load of about 50% of the rated load to be carried. Assuming, by way of example, that the elevator cage carrying a load of more than 50% of the rated load is started in the up-direction, an unbalanced torque will be produced in the down-direction, whereby there takes place upon releasing of the brake without effectuating the starting compensation such a bounce phenomenon that the elevator cage is once moved downwardly before beginning to run in the upward direction. In contrast, the elevator car tends to dash out upon starting in the up-direction with the cage-onboard load (i.e. load carried by the cage) of less than 50% of the rated load.

Such being the circumstance, the elevator starting compensation control is adopted for protecting the elevator cage from degradation in the comfortableness in riding due to the bouncing and dash-out phenomena upon starting of the elevator cage. Typical ones of such starting compensation systems are disclosed, for example, in JP-A-No. 52-53347 (corresponding to Bristish Patent Application No. 43,749 filed in 1976 and now matured to British Patent No. 1,526,369) and JP-A-No. 55-56959.

In the elevator starting compensation systems known heretofore, the starting compensation is performed based on the hardware by regulating or adjusting the output signal produced by a load detecting device disposed underneath the floor of the cage with the aid of a variable resistor. Such adjustment is however very delicate and requires a high level of skill.

Further, the amount of adjustment of the elevator starting compensation varies in dependence on the types of the elevator and must be carried out in the field after installation of the individual elevator system. Apparently, the amount of adjustment as required differs case by case and requires a great deal of troublesome and laborious procedures.

SUMMARY OF THE INVENTION

An object of the present invention is to provide a method and apparatus for elevator starting compensation which allows adjustment of the starting compensation to be carried out in a much facilitated manner with high accuracy.

In view of the above object, it is proposed according to an aspect of the present invention that factors or quantities for adjusting the starting compensation for compensating the unbalanced torque brought about due to a difference in weight between an elevator cage and a counter weight is arithmetically determined by an elevator control micrcomputer, wherein the results of the arithmetic operation are stored in an electrically erasable programmable non-volatile memory so that the starting compensation can be performed by utilizing the adjusting factors or quantities stored in the memory.

In a preferred embodiment of the present invention, the output signals of a load detecting device for detecting the cage-onboard load are converted into digital signals to be subsequently stored in a microcomputer. Upon adjustment of the starting compensation, the elevator cage is set to a no-load state, wherein the signal produced by the load detecting device in this state is inputted to the microcomputer for undergoing a predetermined arithmetic operation. The results of the arithmetic operation are stored in the electrically erasable and programmable non-volatile memory. Additionally, the elevator cage is placed under the rated load, whereupon the information available through a similar processing of the output signal from the load detecting device is arithmetically processed by the microcomputer. The result of this arithmetic processing is also stored in the aforementioned non-volatile memory. On the basis of these two types of data or information, the amount of starting compensation is arithmetically determined by the abovementioned microcomputer for all the input load signals, whereby the amount of starting compensation is outputted for compensating the unbalanced torque. In this way, the adjustment can be much facilitated.

DESCRIPTION OF THE PREFERRED EMBODIMENTS

The invention will be described in detail in conjunction with an exemplary embodiment thereof shown in FIGS. 1 to 4 and 6 by also referring to FIGS. 7 and 8.

Figure 1:
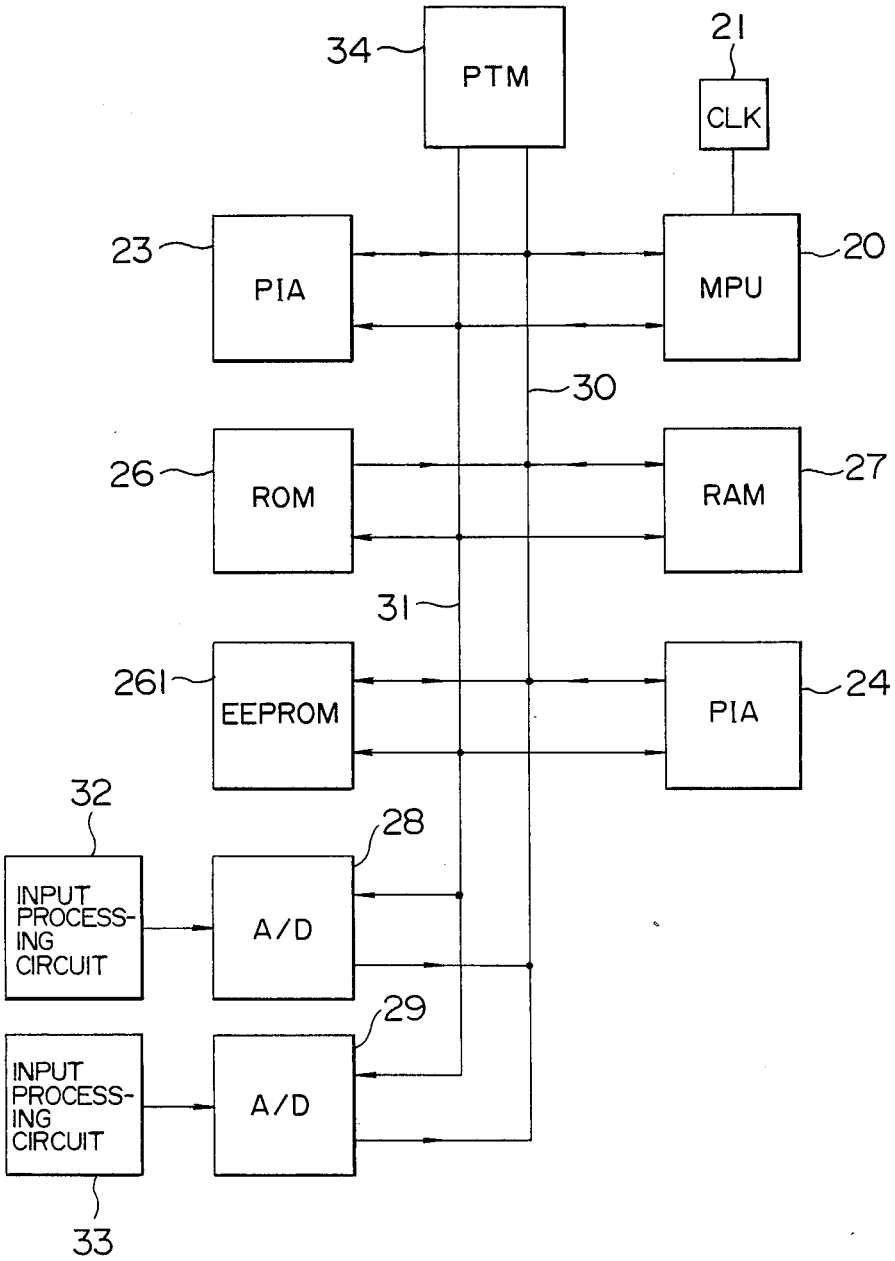
FIG. 1 is a schematic block diagram showing a microcomputer system employed in an elevator starting compensation apparatus according to an embodiment of the present invention.

FIG. 1 shows a general arrangement of a microcomputer-based elevator start compensation/control system according to an embodiment of the present invention which is designed to perform also the elevator control. Referring to FIG. 1, the microcomputer system includes a microprocessing unit (MPU) 20, a clock 21 serving for determining operation timing of the MPU 20 and informing the MPU 20 of lapse of predetermined time intervals, peripheral interfaces (PIAs) 23 and 24 for allowing transaction of external signals with the MPU 20, first non-volatile memory or read-only memory (ROM) 26 destined for storing procedures for the operation of the MPU 20 together with data required therefor, a second non-volatile memory or electrically erasable programmable read-only memory (EEPROM) 261, a random access memory (RAM) 27 used for temporary storage as the work area for the MPU 20, analogue-to-digital (A/D) converters 28 and 29 for converting externally applied analogue signals to digital signals, a data bus 30 for data transfer among the various components, and a control bus 31 serving for selecting the addresses of the memories and the component as well as transfer of the clock, interrupt and other signals. Reference numerals 32 and 33 denote input processing circuits, and a numeral 34 denotes a programmable counter/timer element (PTM in abbreviation) connected to the data bus 30 and the control bus 31.

Figure 2:
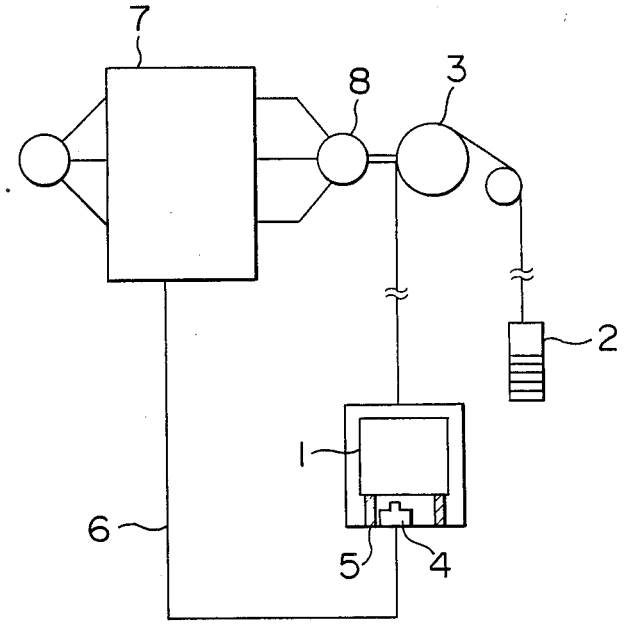
FIG. 2 is a schematic diagram showing a general arrangement of an elevator system to which the starting compensation taught by the invention can be applied.

FIG. 2 shows schematically a general arrangement of an elevator system to which the start compensation apparatus according to the present invention can be applied. An elevator cage 1 is connected to a counter weight 2 and suspend around a sheave 3 of a winding machine in a well-rope fashion. In general, a differential transformer 4 is disposed underneath the cage 1 as the means for detecting the load on the cage 1 (referred to as the cage-onboard load), wherein the outputs of the differential transformer 4 are increased or decreased in dependence the magnitude of deformation of an anti-vibration rubber element 5 which deformation in turn is brought about the magnitude of the load imposed on the cage 1. The output signals of the differential transformer 4 are supplied to a control unit 7 through a tail cord 6. The control unit 7 serves for controlling an induction motor 8. Parenthetically, in place of the straightforward detection of the cage-onboard load in the manner mentioned above, it can also be detected indirectly in terms of unbalanced torque by means of a torque sensor provided in association with a brake of the electric motor.

Next, description will be directed to the rewriting operation of the second rewritable non-volatile memory 261 assumed to be constituted by an EEPROM.

The EEPROM 261 is connected to the data bus 30, the control bus 31 including clock and address bus lines and a power source line 70 of the microcomputer.

The EEPROM 261 is usually operated similarly to the conventional ROM. The data rewriting can be accomplished by producing address and write request signals onto the control bus 31 while sending the data to be written onto the data bus 30. The address signal sent onto the control bus 31 is fetched and held by an address buffer latch 71, while the signal on the data bus 30 is held by an input/output (I/O) buffer/input latch circuit 74. By stepping up the voltage supplied to a memory array 75 incorporated in the EEPROM 261 by activating a high-voltage generating circuit 72, the data writing operation can be carried out. In the case of the data writing operation for the EEPROM 261, it is necessary to write desired data after the data SFF has been once written at a desired address. Further, since the data writing operation requires about 10 ms, it is impossible to write or read out other data in or from the EEPROM 261 in the course of the abovementioned data writing operation. The EEPROM 261 shown in FIG. 3 incorporates the address latch circuit, the data latch circuit and the high voltage generating circuit. By virtue of this structure of the EEPROM 261, the data bus 30 and the address bus can be released for use by other device once the write command has been issued. On the other hand, when the latch circuit and the high voltage generating circuit are not incorporated, the similar function can be attained by adding the corresponding circuits designed for external mounting. A reference numeral 73 denotes an erase/write control circuit.

The use of the erasable non-volatile EEPROM for the elevator control are known, as is disclosed, for example, in JP-A-No. 62-205971, JP-A No. 61-238677 and JP-A NO. 62-111880. However, application of the EEPROM for the cage starting compensation in the elevator system has not yet been reported. Advantages obtained due to the use of the erasable and programmable non-volatile memory such as EEPROM for the elevator control can be seen in that (1) the stored contents are protected against being erased even upon interruption of service without need for the aid of a back-up system and that (2) changes in the situation (changes in the course of time lapse) can be coped with by the rewriting by virtue of the erasable and programmable capability.

Figure 4:
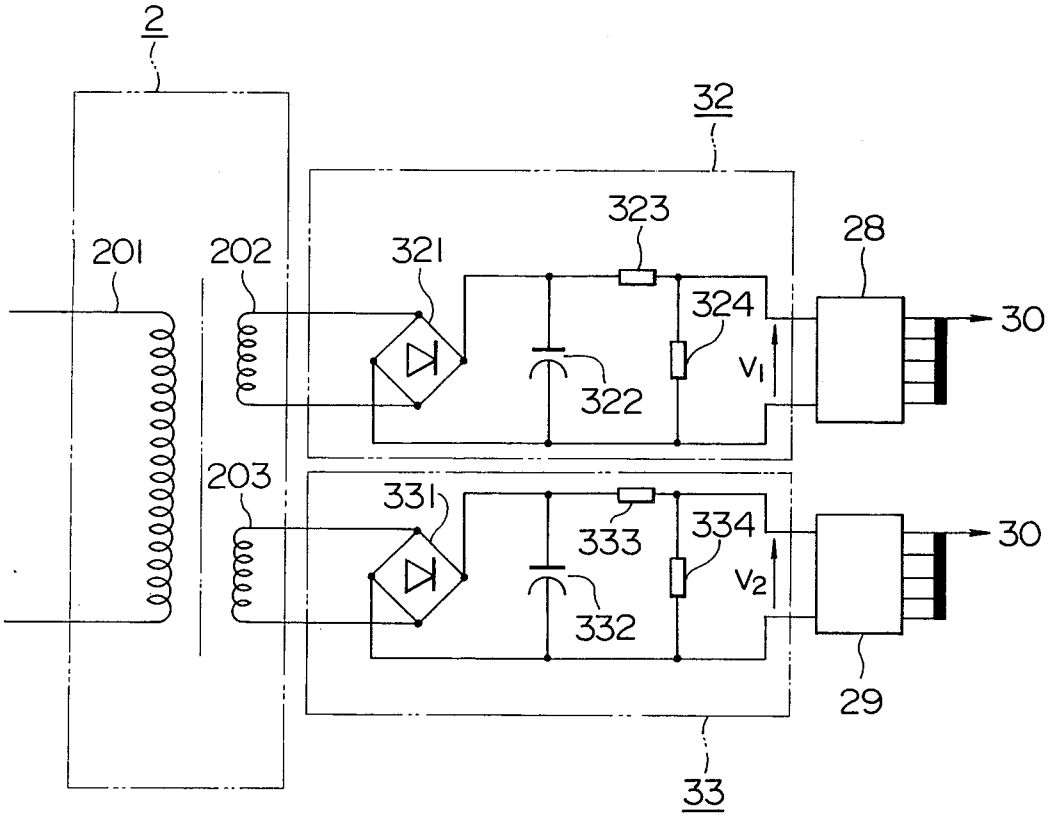
FIG. 4 is a detailed circuit diagram showing a typical load detecting/signal processing apparatus shown in FIG. 1.

FIG. 4 shows in detail the circuit configuration of the input processing circuits 32 and 33 for processing the external analogue signals together with the A/D converters 28 and 29. The differential transformer 2 serving as the cage-onboard load detector for detecting the load on the cage as described hereinbefore in conjunction with FIG. 2 includes a primary winding 201, a secondary winding 202 for producing an output voltage which is decreased as the cage-onboard load is increased and another secondary winding 203 producing an output voltage which is increased as the cage-onboard load is increased. The secondary windings 202 and 203 are connected to the input processing circuits 32 and 33, respectively. The input processing circuits 32 (33) include, respectively, diode bridges 321 (331), smoothing capacitors 322 (332), voltage dividing resistors 323 and 324 (333 and 334), wherein the input processing circuit 32 applies a voltage $V_1$ conforming to the cage-onboard load to the input of the A/D converter 28 while the input processing circuit 33 applies a voltage $V_2$ conforming to the cage-onboard load to the A/D converter 29, the digital output signals of the A/D converters 28 and 29 are transmitted to the MPU 20 over the data bus 30.

Figure 5:
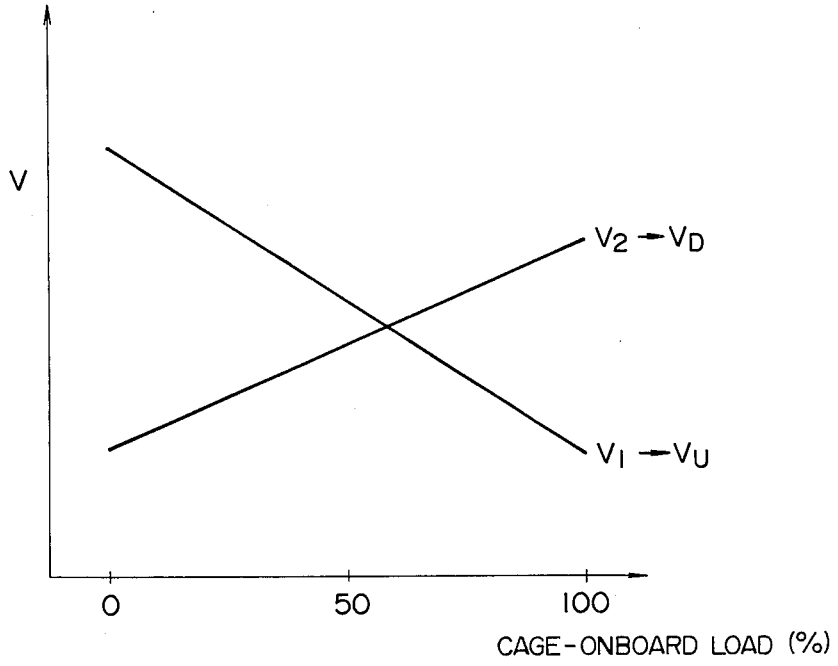
FIG. 5 is a graphic diagram for illustrating relationships between output voltages of the input signal processing apparatus shown in FIG. 4 and the cage-onboard load.
Figure 3:
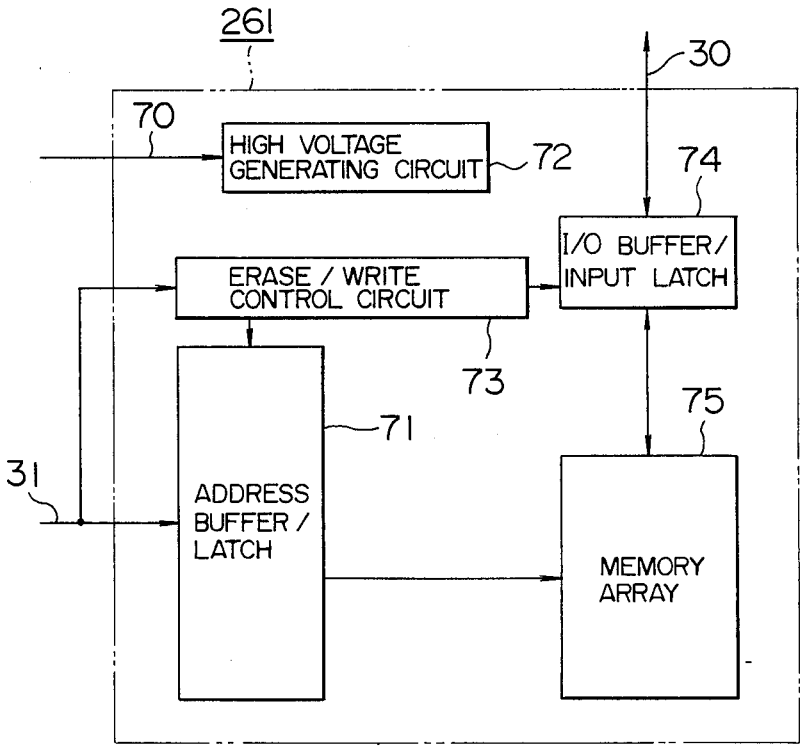
FIG. 3 is view showing an exemplary structure of an electrically erasable programmable non-volatile memory (EEPROM) shown in FIG. 1.

FIG. 5 is a view for graphically illustrating relationships between the cage-onboard load and the output voltages $V_1$ and $V_2$ of the input processing circuits 32 and 33. In FIG. 5, the cage-onboard load is taken along the abscissa as scaled with reference to the rated load of 100% with the output voltages $V_1$ and $V_2$ being taken along the ordinate. In the case of the illustrated example, the output voltage $V_1$ decreases as the cage-onboard load increases, while the output voltage $V_2$ increases as the cage-onboard load increases. Since such characteristics of the differential transformer are well known in the art, further description will be unnecessary.

Figure 6:
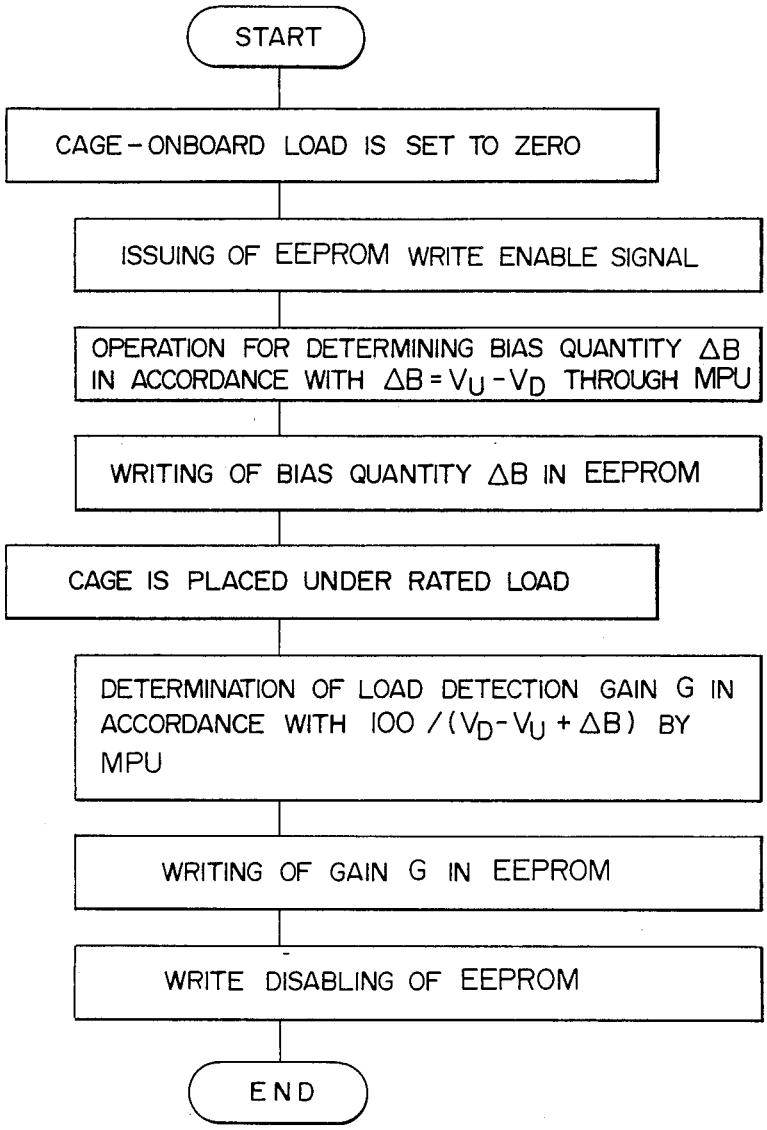
FIG. 6 shows a flow chart for illustrating a process for adjusting or regulating the cage-onboard load detecting apparatus.
Figure 7:
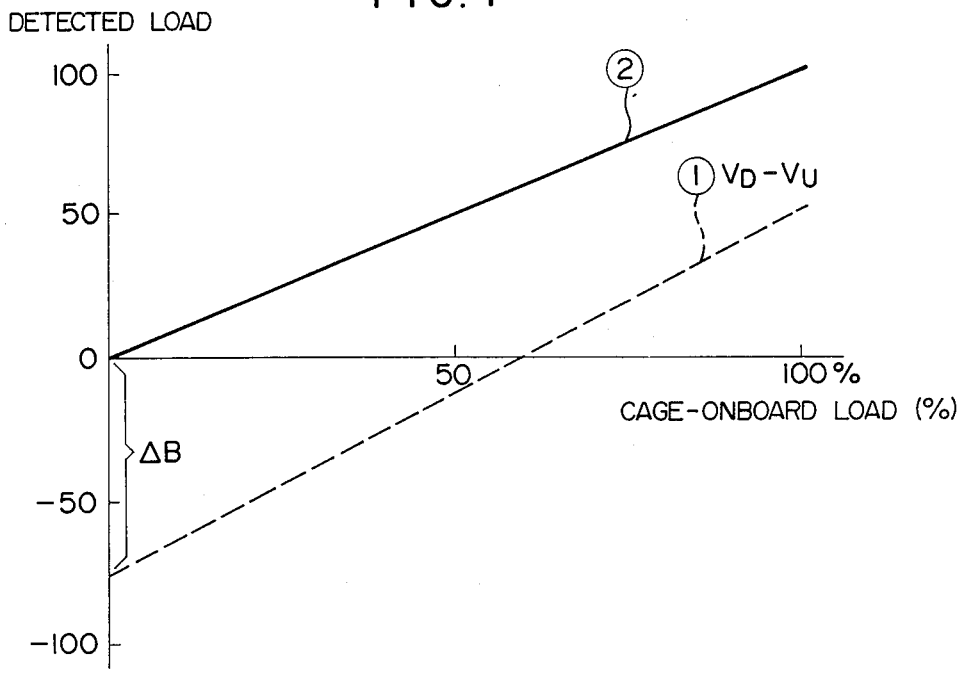
FIG. 7 is a view for graphically illustrating arithmetic operation executed in the procedure shown in FIG. 6.

FIG. 6 shows in a flow chart a processing according to an embodiment of the invention, and FIG. 7 illustrates graphically the results obtained through execution of the processing shown in FIG. 6.

More specifically, FIG. 6 illustrates a method of adjusting the cage-onboard load detecting apparatus with the aid of the arithmetic processing circuit including the load detecting circuit and the MPU 20 described hereinbefore by reference to FIGS. 1 to 5.

Determination of the amount of starting compensation for compensation of the unbalanced torque at the time of installation of the elevator system is a very important procedure for the elevator system for which improved comfortableness in riding is to be assured.

According to this procedure, the cage is set to no-load state. Subsequently, a write enable signal is issued to the electrically erasable and programmable read-only memory (EEPROM) 261 to set the latter to the rewrite enabled state. The signals $V_1$ and $V_2$ derived through processing of the outputs of the differential transformer 2 in the state where the cage is under no load are converted to the digital signals through the A/D converters 28 and 29, respectively. The digital signals corresponding to the abovementioned voltage signals $V_1$ and $V_2$ are represented by VU and VD, respectively. The MPU 20 performs an arithmetic operation for determining first a bias ΔB in accordance with ΔB=VU−VD in response to the write operation command from the control unit 7. The bias data ΔB thus determined is written in the EEPROM 261. Subsequently, the cage is placed under the rated load, and the information of the rated load state is transmitted to the MPU 20 through the similar procedure described above. In this case, the amount of the starting compensation may be determined in accordance with the load characteristic VD−VU shown by a broken line ① in FIG. 7. However, adjustment can be much facilitated through standardization of the detected load by setting the no-load state to zero while setting the 100% rated load state to "100". Such standardization can be accomplished through linear conversion of the VD−VU characteristic given by y=Ax+B and represented by the broken line ① into the characteristic given by Y=CX as indicated by a solid line ②.

In obtaining the characteristic indicated by the solid line in ② FIG. 7, the bias ΔB in the state is already determined. Accordingly, the rated load of 100% can determined by adding the bias to the value of VD−VU and multiplying a gain G. In other words, the gain G is determined as follows:

$$G=100/(VD-VU+\Delta B) \quad (1)$$

This arithmetic operation can be realized automatically by the MPU 20. The gain G thus determined is written in the EEPROM 261 through the procedure described hereinbefore. Subsequently, the writing operation to the EEPROM 261 is disabled.

The detected cage-onboard load can be represented as follows:

$$\text{Detected Load}=G\times(VD-VU+\Delta B) \quad (2)$$

In this way, the detected cage-onboard load can be standardized in the form of a straight line passing through the origin. In the balanced load state, magnitude of the detected load is about 50% of the rated load.

The standardization produces the following advantage.

The motor capacity may be generally decided by the relationship between the speed and the cage-onboard load, however in the elevator having the winding machine using gears, there are elevator types having different speed and cage-onboard load even with the same motor capacity. For example, the motor having the same capacity of 11 KW has one case of the speed and the cage-onboard load 60 m/min and 100 Kg respectively and the other case of the speed and the cage-onboard load 105 m/min and 600 kG respectively. At this time, the output value of the differential transformer with respect to the rating cage-onboard load becomes the value in the case of 100 Kg larger than that in the case of 600 Kg. In order to obtain a good starting compensation, it is necessary to generate the same torque even in different types in speed and cage-onboard load.

In contrast, if the standardization is made as 100 for the load condition of rate 100%, it is possible to generate the same torque without any calculation each different speed and cage-onboard load, thereby obtaining a software in common and facility of adjustment.

Figure 8:
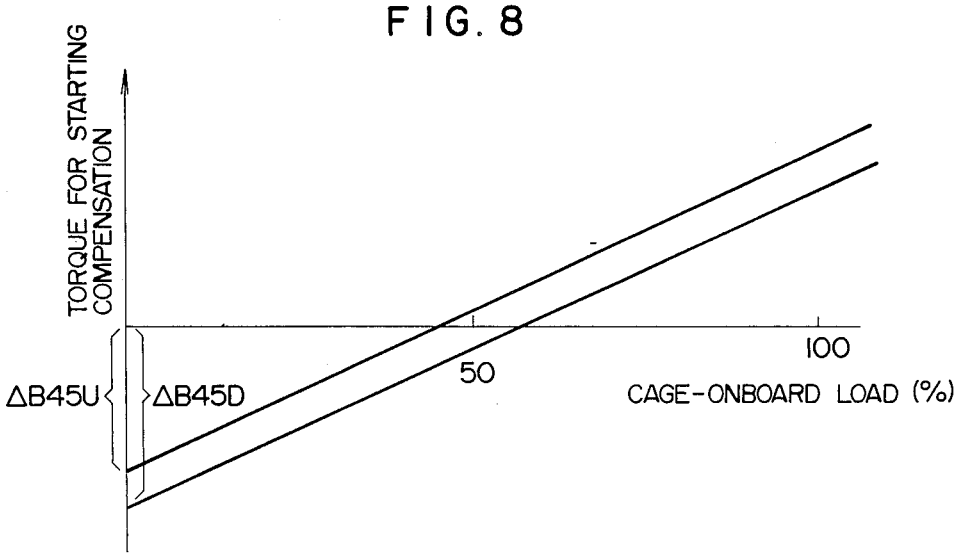
FIG. 8 is a graphic view showing relations between the starting compensation torque issued as the torque command for a drive motor and the detected cage-onboard load.

FIG. 8 is a view for graphically illustrating a torque command for the electric motor 8 conforming to the detected load in the form converted to the amount of the starting compensation.

The balanced point in the elevator system lies in the range of 45 to 50%. For correcting the change in the cage-onboard load with reference to the balanced point, the change ΔB45U from the balanced point in the up-running operation and the change ΔB45D from the balanced point in the down-running operation are previously determined. Similarly, the detected load as well as the gain GTRQ for transforming the detected load to the amount of starting compensation are also determined previously. Then, quantities for the final starting compensation for the car-onboard load can be determined optimally through arithmetic operation by the MPU 20 as follows:

(1) In the up-running operation $$\text{Starting Compensation}=GRRQ\times(\text{Detected Load})-\Delta B45U \quad (3)$$

(2) In the down-running operation $$\text{Starting Compensation}=GTRQ\times(\text{Detected Load})-\Delta B45D \quad (4)$$

It goes without saying that the quantities ΔB45U, ΔB45D and GTRQ can stored rewritably in the EEPROM 261, whereby maintenance can be facilitated.

As will now be appreciated from the foregoing description, there can be attained the facilitated detection of the cage-onboard load and adjustment of the starting compensation by using the microcomputer and the electrically erasable programmable non-volatile memory.

We claim:

1. An elevator starting compensation method for compensating an unbalanced torque due to a difference in weight between an elevator cage and a counter weight comprising the steps of:

(a) processing parameters of an arithmetic operating equation which calculates starting compensation quantities from data related to a load obtained in a voluntary and an actual condition, said data related to said load being developed when said elevator cage is set in a predetermined light-load condition and when said elevator cage is set in a predetermined heavy-load condition;

(b) storing said arithmetic operating equation and said parameters into an electrically erasable programmable non-volatile memory;

(c) processing said starting compensation quantities based on said data related to said load obtained in said actual condition, said stored arithmetic operating equation, and said stored parameters at a starting time of operation of said elevator cage; and (d) compensating a starting torque at said starting time in accordance with said starting compensation quantities.

2. An elevator control system including load detecting means for detecting a load applied to a cage in an elevator system, a microcomputer for controlling said elevator system, signal conversion means for converting the output of said load detecting means to a digital signal, an electrically erasable programmable non-volatile memory, and signal generating means for issuing a write enable signal to said comprising:, an elevator starting compensation apparatus arranged such that factors employed for adjusting said load detecting means are arithmetically determined by said microcomputer and stored in said non-volatile memory.

3. An elevator control system according to claim 2, wherein said factors employed for adjusting said load detecting means are arithmetically determined by said microcomputer on the basis of data derived in the no load state and data derived in the rated load state.

4. An elevator starting compensation apparatus according to claim 3, wherein in the arithmetic operation, said data are standardized by setting the data value derived in the no load state to "0" (zero) while setting the data value derived in the rated load state to "100".

5. An elevator control system including means for detecting unbalanced torque due to a difference in weight between an elevator cage and a counter weight, a microcomputer provided for elevator control, an electrically erasable programmable non-volatile memory, and signal generating means for issuing a write enable signal to said memory, comprising an elevator starting compensation apparatus arranged such that factors for adjusting said unbalanced torque detecting means are arithmetically determined by said microcomputer and stored in said non-volatile memory.

* * * * *